United States Patent [19]

Van Bogaert et al.

[11] Patent Number: 4,813,460

[45] Date of Patent: Mar. 21, 1989

[54] DEVICE FOR THE INSERTION OF WEFT THREADS INTO THE SHED OF AIR-LOOMS AND ADJUSTABLE BLOWERS USED TO THIS END

[75] Inventors: Philippe Van Bogaert, Schaerbeek; Jean-Marie Bamelis, Ieper, both of Belgium

[73] Assignee: Picanol N.V., Belgium, Belgium

[21] Appl. No.: 16,738

[22] Filed: Feb. 20, 1987

[30] Foreign Application Priority Data

Feb. 21, 1986 [BE] Belgium ..... 904260

[51] Int. Cl.[4] ..... D03D 47/30

[52] U.S. Cl. ..... 139/435; 226/97

[58] Field of Search ..... 139/435, 452; 226/97

[56] References Cited

U.S. PATENT DOCUMENTS

| | | | |
|---|---|---|---|
| 4,457,346 | 7/1984 | Nagashima | 139/435 |
| 4,458,726 | 7/1984 | Wenig | 139/435 |
| 4,542,772 | 9/1985 | Gaschutz | 139/435 |
| 4,550,754 | 11/1985 | Iida | 139/452 |

FOREIGN PATENT DOCUMENTS

| | | | |
|---|---|---|---|
| 0023929 | 2/1981 | European Pat. Off. . | |
| 0071246 | 2/1983 | European Pat. Off. . | |
| 1531853 | 7/1967 | France . | |
| 2364989 | 9/1976 | France . | |
| 3907 | of 1970 | Japan | 139/435 |
| 27100 | 9/1975 | Japan | 139/435 |
| 59-125941 | 12/1982 | Japan . | |

*Primary Examiner*—Henry S. Jaudon

*Attorney, Agent, or Firm*—Bacon & Thomas

[57] ABSTRACT

A device for the insertion of weft thread into a shed of air insertion looms primarily consists of the combination of a main nozzle, and of at least one auxiliary nozzle fixedly mounted before the main nozzle, the latter having an adjustable flow-through aperture for regulating the jet insertion medium. Associated with each auxiliary nozzle, a control means is utilized for the adjustment of the flow-through aperture. Various embodiments of aperture control are described.

11 Claims, 3 Drawing Sheets

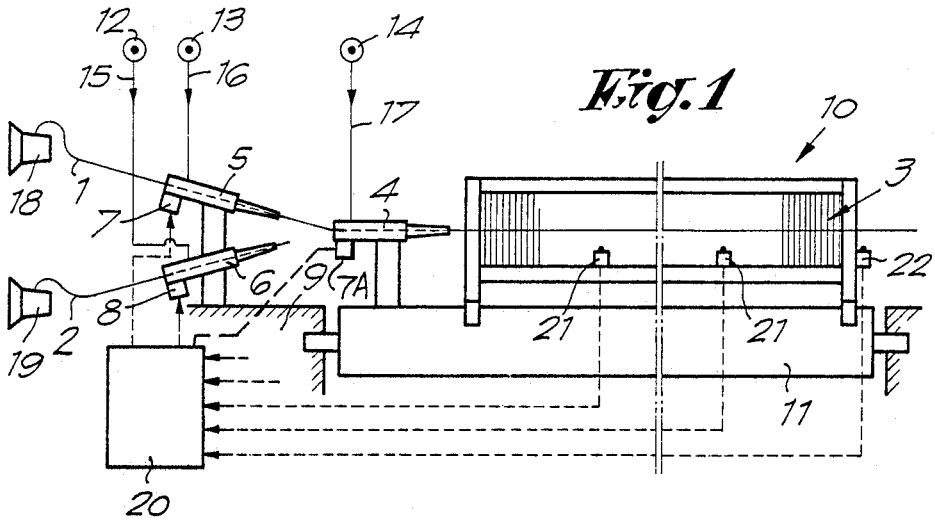
Fig. 1
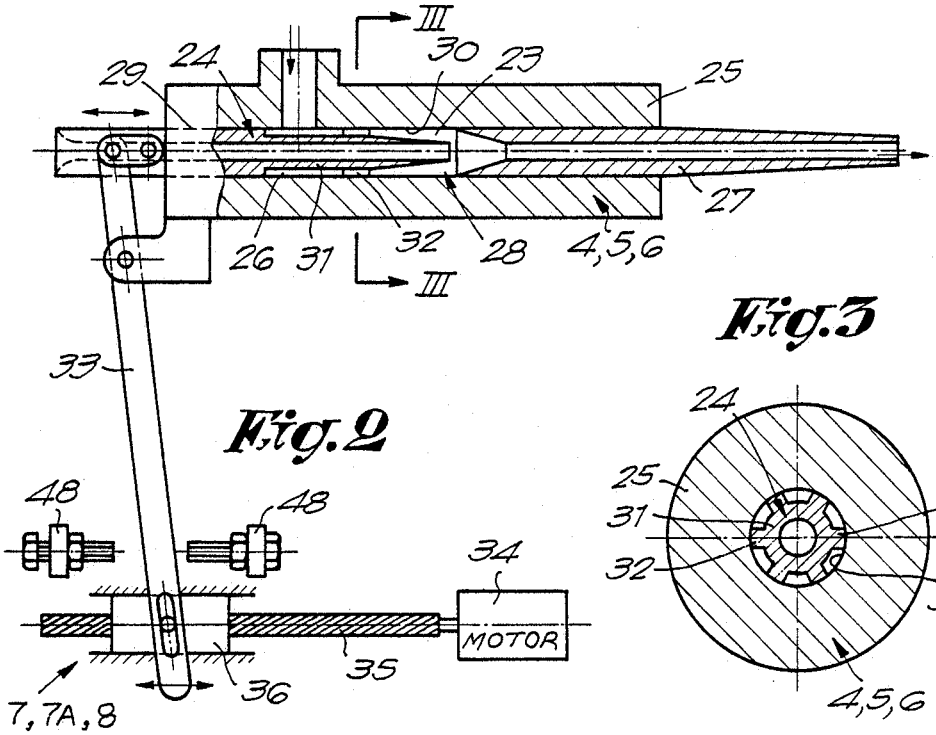
Fig. 2
Fig. 3
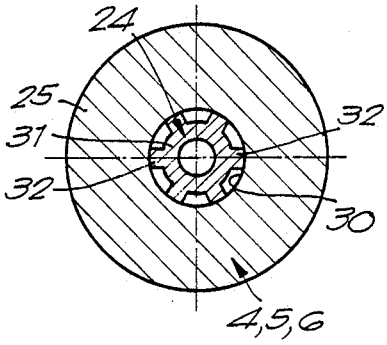

Fig. 4
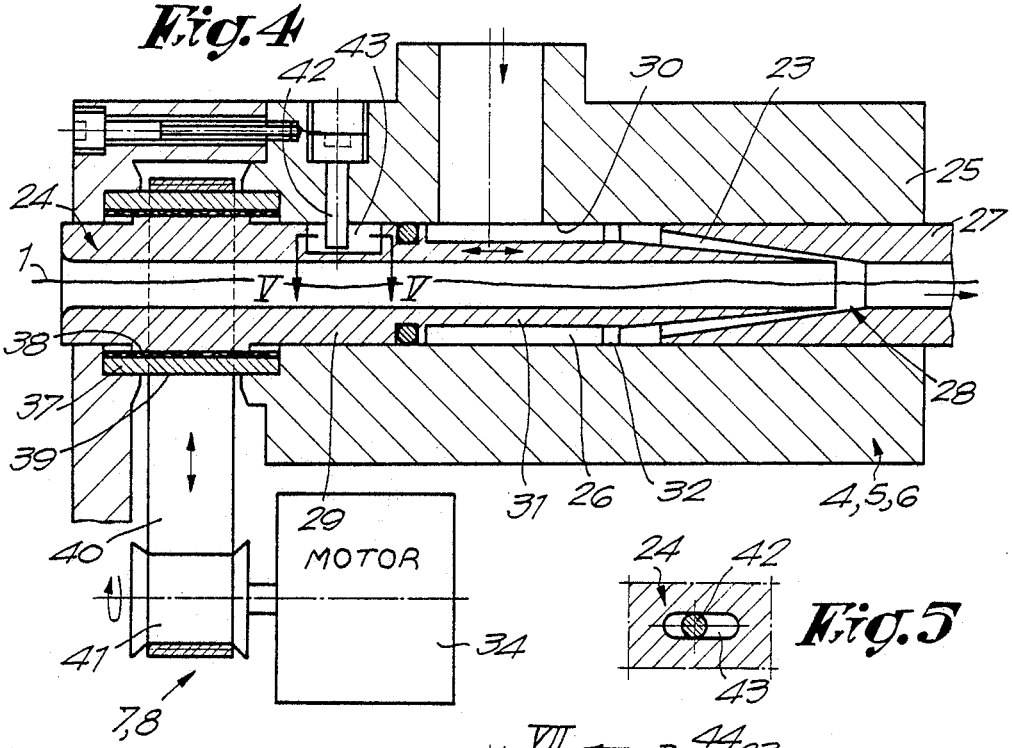
Fig. 5
Fig. 6
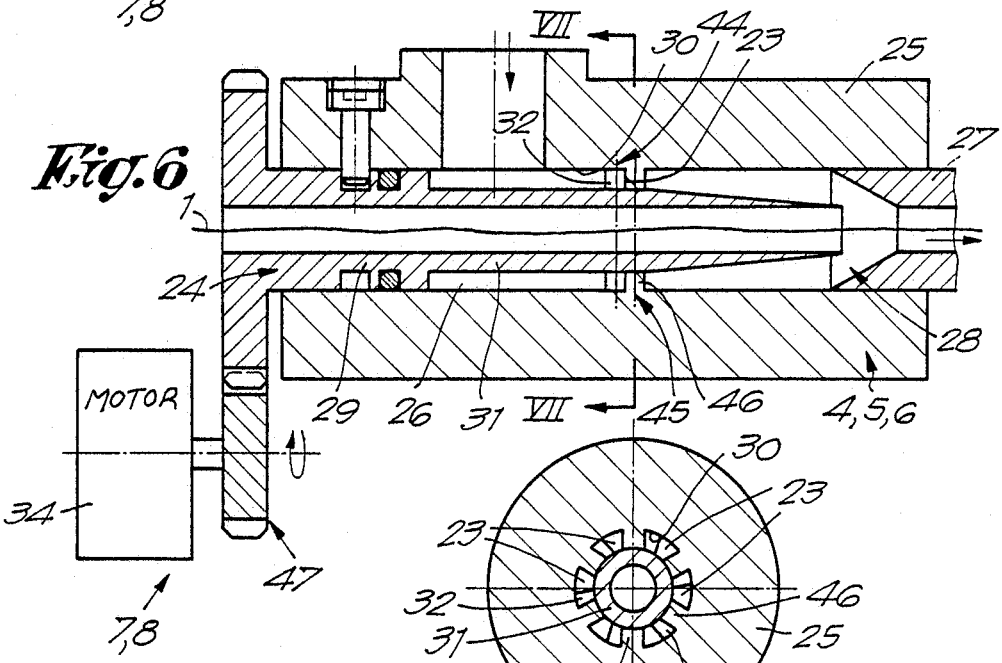
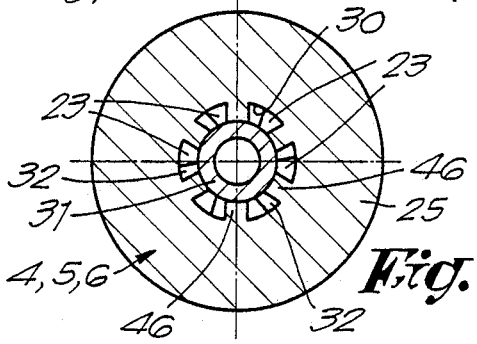
Fig. 7

DEVICE FOR THE INSERTION OF WEFT THREADS INTO THE SHED OF AIR-LOOMS AND ADJUSTABLE BLOWERS USED TO THIS END

BACKGROUND OF THE INVENTION

This invention concerns a device for the insertion of weft threads into the shed of air looms and also adjustable nozzles which can be used with this device.

It is already known that the variable parameters involved in the insertion of weft threads into sheds of air looms can be adjusted in accordance with measurements carried out on the weft threads during their insertion into the shed. The variable insertion parameters which are usually applied are the working time and/or the working pressures and/or the air flow rate of the nozzles of the loom.

It is already known that, for looms in which several thread types are used, for instance multicolor machines, the aforesaid insertion parameters can be modified according to the weaving pattern. In other words, well known characteristics of the thread type are applied in modifying the variable insertion parameters.

The Japanese Published patent application No. 59-125941 described a method whereby the flow-through aperture of the main insertion nozzle is automatically adjusted according to various weaving parameters and weaving results. However, this method has the disadvantage that it is practically impossible to apply to main nozzles which move with the sley because the nozzles rapidly reciprocate so that a fine and accurate regulation of the aperture is impossible.

It is already known in multicolor weaving to supply the weft threads to a main nozzle by means of corresponding auxiliary nozzles. To this end the weft insertion parameters must be adapted in accordance with the characteristics of the various kinds of weft thread and in accordance with the measurements carried out in the shed whereby a combination of main and auxiliary nozzles can be provided with regulation of the main nozzle by means of a regulating system as described in the above Pat. No. JP 59-125941. This combination is also disadvantageous, however, because a flow-through aperture of the main nozzle must be instantaneously adjusted, sometimes involving a relatively large modification for each color and in many cases also for each shot, which is hardly feasible at very high speeds.

SUMMARY OF THE INVENTION

The present invention is thus intended to offer a solution to the drawbacks reported hereabove. To this end the invention is composed of a device for the insertion of weft threads into a shed whereby use is made of the combination of a main nozzle, of at least one auxiliary stationary nozzle mounted before (upstream of) the main nozzle and which has an adjustable flow-through aperture for the supplied insertion medium or the transport medium, and of a drive or control means for each auxiliary nozzle for regulating the adjustable flow-through aperture, whether or not the main nozzle is moving with the sley of the loom.

This installation has the advantage that the variable weft thread insertion parameters can be modified by separate adjustments of the auxiliary nozzles, where these are all first adjusted in accordance with the kind of weaving threads for which each one will be used, and secondly, they are all adjusted in relationship with the measurements which are carried out on their corresponding weft threads during the insertion into the shed. Quite obviously these auxiliary nozzles, which are mounted as stationary elements, for instance by fastening on the loom frame, enable a precise and very fine adjustment. Since one auxiliary nozzle is contemplated for each kind of weaving weft thread used, it is not necessary that the flow-through aperture of these auxiliary nozzles be immediately modified with sudden adjustments to adjust for different threads, and only complementary adjustments must be carried out.

Another objective of the invention consists in employing main or auxiliary nozzles, where the flow-through aperture for the supplied medium can be automatically adjusted by means of a control means.

BRIEF DESCRIPTION OF THE DRAWINGS

The characteristics of the invention will be better understood with reference to the accompanying drawings, wherein a few preferred embodiments are described.

In the drawings:

FIG. 1 is a schematic view of the device according to the invention.

FIG. 2 is an adjustable nozzle according to the invention.

FIG. 3 is an enlarged cross-section taken along line III–III of FIG. 2.

FIG. 4 is a cross-section through another adjustable nozzle according to the invention.

FIG. 5 is a cross-section taken along line V—V of FIG. 4.

FIG. 6 is still another adjustable nozzle according to the invention.

FIG. 7 is a cross-section along line VII—VII of FIG. 6.

With reference to the drawings, FIG. 1 illustrates a preferred embodiment of the device according to the invention, wherein two weft threads 1 and 2 are to be introduced according to a previously determined weaving pattern into the shed 3 of an air insertion loom the relevant parts of which are generally schematically illustrated in FIG. 1. The device is mainly composed of the combination of a main nozzle 4, of several (in the present case two) auxiliary nozzles 5, 6 located before or upstream of the main nozzle 4 and which are capable of adjusting their flow-through apertures for the supplied insertion medium by a driving or control means, respectively 7 and 8 for each auxiliary nozzle 5, 6, in order to achieve the regulation of their flow-through apertures.

Figure 8:
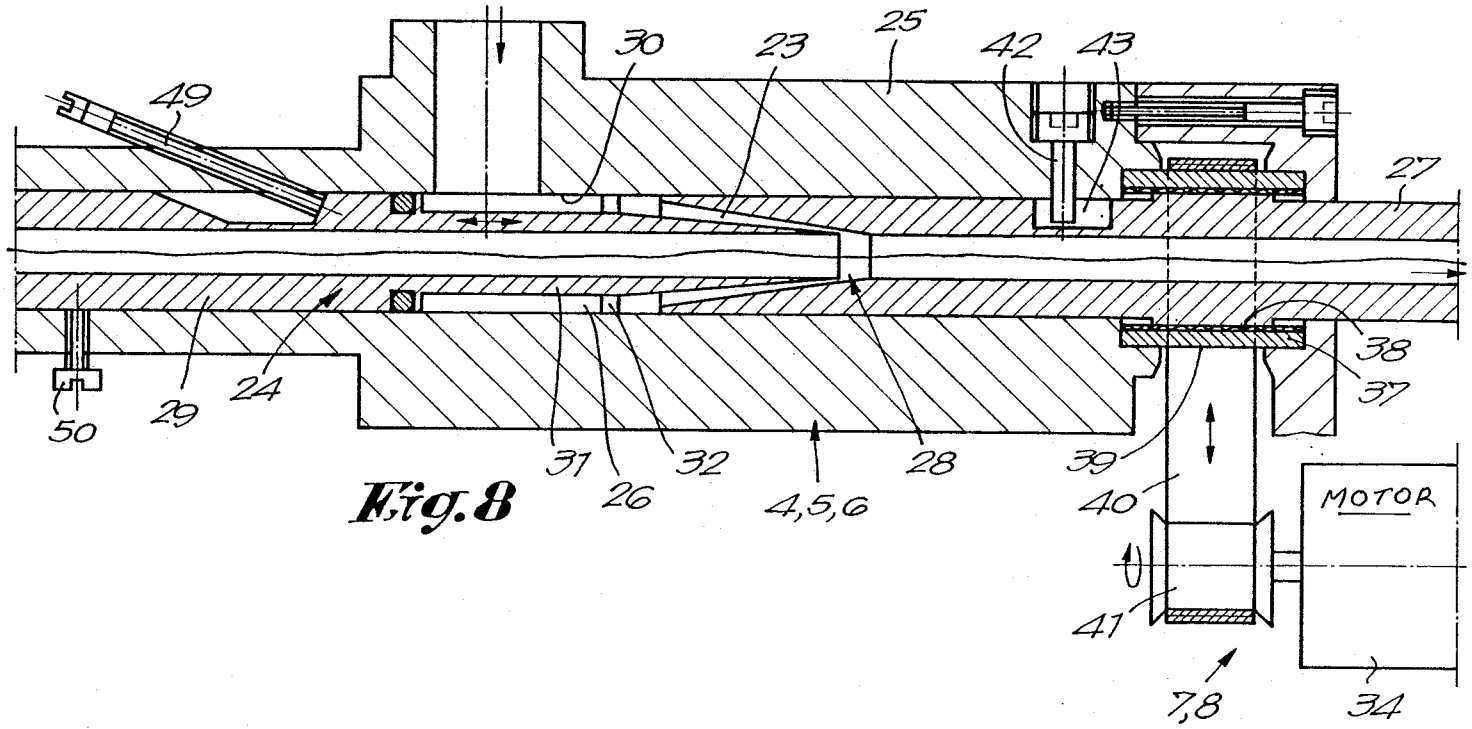
FIG. 8 is an alternative embodiment of FIG. 4.

According to the invention, the auxiliary nozzles 5 and 6 are fixedly secured to the loom frame 9. The main nozzle 4, as illustrated by FIG. 1, preferably can be moved with the sley 10 of the loom and is secured for this purpose, for instance, on the sley shaft 11. According to an alternative embodiment of the invention, the main nozzle 4 can also be fastened on the loom frame 9. According to this embodiment, the main nozzle can also include an adjustable flow-through aperture regulated by control means *7a* for the supplied medium.

FIG. 1 also illustrates the compressed air connections 12 to 14 and the supply lines 15 to 17 of the two auxiliary nozzles 5 and 6 and of the main nozzle 4, respectively. It is possible for some of these compressed air connection to be common to different nozzles. The weft threads 1 and 2 can be unwound, for instance, by unwinding coils, respectively 18 and 19.

The adjustment of the flow-through aperture of the auxiliary nozzles 5 and 6 and of the main nozzle 4, as well as their control means, in particular, the control means 7 and 8, will be described in more detail with reference to FIGS. 2–7 where these nozzles are illustrated in more detail.

As illustrated in FIG. 1, the device in accordance with the invention, and more specifically the control means 7 and 8, is controlled by means of a controlling unit 20 which carries out the control in accordance with speed measurements made on the weft threads 1 and 2 during the insertion of a weft thread into the shed 3. The measurements be carried out according to already well known methods. For example, according to FIG. 1, the measurements are carried out by means of detectors 21 which are located in the shed 3 and of a weft controller 22 which is located near the end of the shed 3. The detectors 21 and the controller 22 are all connected to the control unit 20. However, the measurements carried out by the detectors 21 and 22 could also be achieved by measuring on winding coils 18 and 19.

The operation of the device of FIG. 1 can be explained as follows: Each auxiliary nozzle, respectively 5 and 6, is regulated in such a way that the corresponding weft thread, respectively 1 and 2, can be introduced into the shed 3 in an optimal manner for the particular type of thread being used. According to the measurements which are carried out by means of the detectors 21 and 22, the control unit 20 regulates the flow of fluid through the adjustable flow-through aperture of the auxiliary nozzles 5 and 6. The complementary adjustments of an aperture can be based on, for instance, the measurement results from a previous insertion of the same type of weft threads. Preferably the adjustment of the flow-through aperture can be also carried out in accordance with the average of several measurements which were carried out on the same type of weft threads 1 or 2. The functioning of the device according to the invention can also be combined with other already known control systems for nozzles of looms, either moving or not moving whereby, for instance, the switching on times and the pressures in the supply lines 15 to 17 can also be adjusted.

As illustrated by FIGS. 2–7, several nozzles having an adjustable flow-through aperture 23 for the supplied medium are described, these nozzles being specially suited for the device described above and more specifically in connection with the construction illustrated by FIG. 1, which is designed primarily for the adjustable nozzles 5 and 6, but which may also employ an adjustable main nozzle 4. The nozzles illustrated here are mainly composed of a weft thread supply channel 24, an insertion jet medium supply channel 26 surrounded by a casing 25 and located concentrically around the weft thread supply channel for supplying the jet medium, and a mixing pipe or a jet pipe 27 located as a continuation of the weft thread supply pipe 24 whereby the supply channel 26 discharges between the end 28 of the thread supply pipe 24 and the beginning of mixing pipe 27.

In the embodiment according to FIG. 2, the weft thread supply pipe 24 is axially slidably movable in the casing 25. To this end, the rear part 29 of the weft thread supply pipe 24 is designed in such a way that it can be fitted exactly in the axial hole 30 of the casing 25. The circumference of the front part 31 of the supply pipe is reduced in order to form the concentric medium supply channel 26. In order to keep the front part 31, and more specially the end 28 of the weft thread supply pipe 24, always perfectly in the center of the hole 30, guiding elements are mounted on the outside wall of the front part 31. These guiding elements cooperate with the inside wall of the hole 30 and are composed, for instance, of teeth or lands 32 as illustrated by FIGS. 2 and 3. The control means which achieve the regulation of the adjustable flow-through aperture 23 is indicated in FIG. 1 by, respectively, reference Nos. 7 and 8. One such driving means, shown in FIG. 2, consists of a lever mechanism 33 which is connected at one end with the weft thread supply pipe 24 and which is controlled by means of a control motor 34, a worm shaft 35, and a sliding block 36 connected to the other end of the lever. Operation of motor 34 rotates worm shaft 35 to move nut 37 axially of the shaft 35 to reciprocate lever 33 about its fixed pivot to cause reciprocation of supply pipe 24 within casing 25 to thereby vary the flow-through aperture between supply pipe 24 and jet pipe 27.

FIG. 4 illustrates an alternative embodiment where the weft thread supply pipe 24 is axially movable by means of a nut 37 locked against axial movement and which can cooperate with threading 38 provided on the weft thread supply pipe 24, whereby nut 37 is rotated by means of the control motor 34. The nut 37 has on its outside surface a cylindrical surface 39 whereon a belt 40 can be guided and driven by means of a driving spindle 41 connected to the motor 34.

The weft thread supply pipe 24 is locked against rotation by means of a pin 42 (See FIG. 5) or similar device, which is secured in the casing 25 and which extends into an axially extending groove 43 which is made in the weft thread supply pipe 24. Rotation of motor 34 rotates spindle 41 to drive belt 40 in either direction to cause rotation of nut 37 which axially drives weft thread supply pipe 24 relative to jet pipe 27 to vary the flow-through aperture 23 between pipe 24 and pipe 27.

The functioning of the embodiments according to FIGS. 2 and 4 results in the adjustment of the restriction of the adjustable flow-through aperture 23 caused by the axial displacement of the weft thread supply pipe 24.

FIG. 6 illustrates an alternative embodiment, whereby the weft thread supply pipe 24 and the casing 25 are provided with cooperating teeth or blades 32 and 46, respectively, in two successive sections of the supply pipe 44 and the casing 45 in an axial direction. The teeth 32 and the blades 46 both extend into the supply channel 26 where they are disposed near each other along one of their axial faces. The weft thread supply pipe 24 is locked against axial displacement and can only rotate. Therefore, the weft thread supply pipe 24 can undergo small angular adjustments which are controlled by means of the control motor 34 and a gear transmission 47.

The flow adjustment of the embodiment of FIG. 6 results from the rotation of the teeth 32 and blades 46 relative to each other, which modifies the size of the flow-through aperture 23 as illustrated by FIG. 7.

In the embodiment of FIG. 2, the control means 7 and 8 may also be provided with end stops 48. These end stops 48 makes it possible, for instance by means of an additional control means not illustrated in the figures, to adjust the flow for a short time to one of the extreme positions in cooperation with an end stop 48. In this way, if a detector 21 senses that a weft thread 1 or 2 is moving into the shed 3 too slowly, it is possible to increase the speed of the weft thread by instantaneously completely opening the flow-through aperture 23 up to stop 48 for a short time in order to accelerate the weft thread involved.

FIG. 8 illustrates still another embodiment whereby, instead of the weft thread supply pipe 24, the mixing pipe 27 is axially movable in the casing 25. The displacement can be obtained for instance by applying the control means 7–8, as already described in the embodiment of FIG. 4, to the mixing pipe 27, i.e., by the cooperation of nut 37 and of threading 38 which is now provided on the mixing pipe 27. The corresponding elements of the drive means 7–8 are illustrated with the same reference numbers on FIG. 8 as on FIG. 4. Alternatively, the weft thread supply pipe 24 can be adjusted to an average value of the flow-through aperture 23 by means of a rough regulation achieved with an adjusting screw 49, and then locked in place by a locking set screw 50.

The embodiment according to FIG. 8 offers mainly two advantages over the embodiment of FIG. 4. As a relatively large amount of dust forms in the area of the weft thread supply into the weft thread supply pipe, the driving means 7–8 according to FIG. 4 must have a dust tight construction. With an adjustment control where the driving means 7–8 is located at some distance from the dust source, as it is in the embodiment on FIG. 8, an advantage is gained from the fact that no precautions must be taken against dust penetration. The second advantage results from the fact that the mixing pipe 27 is better guided in the hole 30 than the reduced part 31 of the weft thread supply pipe 24 because contact is maintained with the full inside surface of the casing 25. Consequently, in the case of axial movement, no displacement from the center can occur, caused for instance by tolerance errors, while displacement is possible in the embodiment with the free end 28 of the thread supply pipe 24 of FIG. 4.

The present invention is by no means limited to the examples described hereabove and to the embodiments illustrated by the figures, but the device for the insertion of weft threads into the shed of looms, as well as the adjustable nozzles used to this end, can be designed according to various alternative solutions without departing from the scope of this invention.

What is claimed is:

1. A device for fluid insertion of a weft thread into a shed of an air-jet weaving loom, comprising:

a main weft insertion nozzle adjacent the insertion end of a loom shed, said main nozzle is being secured to said sley for movement therewith relative to said auxiliary nozzle;

at least one stationary auxiliary nozzle mounted upstream of said main nozzle in weft feeding communication with said main nozzle, said auxiliary nozzle comprising an adjustable flow-through aperture for varying the flow of an insertion fluid through said auxiliary nozzle; and a control means in driving connection with said adjustable flow-through aperture, said control means arranged to adjust said adjustable flow-through aperture to vary the flow of the insertion fluid through said auxiliary nozzle.

2. A device according to claim 1, wherein said main nozzle comprises an adjustable flow-through aperture for varying the flow of an insertion fluid through said main nozzle, and control means in driving connection with said adjustable flow-through aperture of said main nozzle, said control means arranged to adjust said adjustable flow-through aperture of said main nozzle to vary the flow of insertion fluid through the main nozzle.

3. A device according to claim 1, said auxiliary nozzle including relatively movable flow-through aperture elements, relative movement of said elements producing variation of the flow-through aperture, said control means including a drive motor means connected to the relatively movable elements for causing relative movement between them, and means for controlling energization of the drive motor means.

4. A device according to claim 1, said loom including weft detectors arranged to measure the speed of weft thread insertion into the loom shed and for providing a signal indicative of said weft speed insertion, said control means including means responsive to the weft thread speed signal and arranged to adjust the adjustable flow-through aperture in response to said signal.

5. A device according to claim 1, said auxiliary nozzle comprising:

a casing having a longitudinal opening extending in the direction of weft insertion, said opening terminating at a mixing pipe means;

a weft thread supply pipe disposed axially spaced apart from the mixing pipe means and concentrically in the casing opening, the space between said supply pipe and mixing pipe means comprising said adjustable flow-through aperture;

a fluid jet supply means arranged to admit weft insertion medium into the space between the supply pipe and mixing pipe means;

said supply pipe and mixing pipe means being movable relative to each other, relative movement of the supply pipe and mixing pipe means causing variation of the size of the flow-through aperture;

drive motor means arranged to move the supply pipe relative to the mixing pipe means to thereby vary the space between the supply pipe and mixing pipe means for varying said flow-through aperture; and control means for controlling energization of the drive motor means.

6. A device according to claim 5, said drive motor means arranged to drive the supply pipe and mixing pipe means axially relative to each other to vary said space between them, and a driving connection between the drive motor and at least one of the supply pipe and mixing pipe means.

7. A device according to claim 6, said driving connection comprising a lever arranged to convert drive motor output to axial displacement of one of the supply pipe and mixing pipe means relative to the other.

8. A device according to claim 6, wherein one of said supply pipe and mixing pipe means includes a threaded section mating with a rotatable threaded nut element, said driving connection including a motion transmission means between said drive motor and said nut for rotating the nut in response to drive motor output, rotation of said nut causing axial displacement of the supply pipe or mixing pipe means including the threaded section to vary said space between the supply pipe and mixing pipe means.

9. A device according to claim 1, said auxiliary nozzle including a longitudinal opening extending in the direction of weft insertion, a weft thread supply pipe disposed concentrically in said opening; said casing including at least one axial opening communicating with said longitudinal opening and supply pipe said axial opening constituting said flow-through aperture; said weft thread supply pipe including means for selectively varying the size of said axial openings upon rotation of the weft thread supply pipe; said control means arranged to selectively rotate said supply pipe to vary said axial openings.

10. A device according to claim 9, said control means including a drive motor, means connecting said drive motor to said weft thread supply pipe in driving relationship, and means for controlling operation of said motor for selectively varying said flow-through aperture.

11. A device according to claim 9, said at least one axial opening comprising longitudinally extending slots in the inner wall of the longitudinal opening of the casing separated by inwardly radially projecting teeth extending into said opening from the casing, said weft thread supply tube including radially projecting teeth arranged to progressively cover and uncover said slots when the weft thread supply tube is rotated, relative rotation of the weft thread supply tube and the casing causing progressive opening and closing of said slots.

* * * * *